US006682137B2

(12) United States Patent
Hsia

(10) Patent No.: US 6,682,137 B2
(45) Date of Patent: Jan. 27, 2004

(54) ADJUSTABLE FRAME OF ROCKER

(76) Inventor: Ben Ming Hsia, 19401 Business Center Dr., Northridge, CA (US) 91324

( * ) Notice: Subject to any disclaimer, the term of this patent is extended or adjusted under 35 U.S.C. 154(b) by 197 days.

(21) Appl. No.: 09/851,526

(22) Filed: May 7, 2001

(65) Prior Publication Data

US 2002/0063457 A1 May 30, 2002

Related U.S. Application Data

(60) Provisional application No. 60/202,336, filed on May 5, 2000.

(51) Int. Cl.[7] ..... A47D 13/10; A47C 3/02

(52) U.S. Cl. ..... 297/32; 297/354.13; 297/364; 297/271.6; 297/258.1; 297/270.5; 297/373; 297/376; 297/183.4; 297/DIG. 11

(58) Field of Search ..... 297/32, 271.6, 297/270.5, 258.1, 364, 365, 373, DIG. 11, 376

(56) References Cited

U.S. PATENT DOCUMENTS 3,731,342 A * 5/1973 Cousin ..... 297/365 X
4,718,715 A * 1/1988 Ho ..... 297/32
5,069,474 A * 12/1991 Tai ..... 280/47.4 X
5,240,265 A * 8/1993 Huang ..... 280/47.4
5,308,143 A * 5/1994 Cheng et al. ..... 297/DIG. 11 X
5,364,137 A * 11/1994 Shimer ..... 297/130 X
5,482,311 A * 1/1996 Huang ..... 297/354.13 X
5,551,745 A * 9/1996 Huang ..... 297/184.17 X
5,868,459 A * 2/1999 Welsh, Jr. ..... 297/32
5,961,180 A * 10/1999 Greger et al. ..... 297/183.4
6,174,028 B1 * 1/2001 Yang et al. ..... 297/271.6 X
6,331,032 B1 * 12/2001 Haut et al. ..... 297/256.16 X
6,341,816 B1 * 1/2002 Chen et al. ..... 297/DIG. 11 X
6,361,106 B1 * 3/2002 Huang ..... 297/32

* cited by examiner

*Primary Examiner*—Rodney B. White
(74) *Attorney, Agent, or Firm*—Raymond Y. Chan; David and Raymond Patent Group

(57) ABSTRACT

An adjustable frame of rocker includes a rocking frame and a supporting frame foldably coupled with the rocking frame, wherein the rocking frame includes a pair of coupling means for pivotally coupling two supporting arms with a supporting frame, so as to inclinedly support the supporting frame in position. Moreover, by unlocking the coupling means, the supporting frame is capable of pivotally rotating about the coupling means in order to adjust the inclination of the supporting frame.

9 Claims, 9 Drawing Sheets

ADJUSTABLE FRAME OF ROCKER

CROSS REFERENCE RELATED TO THE APPLICATION

This is a regular application of a provisional application, serial No. 60/202,336, filed May 05, 2000.

BACKGROUND OF THE PRESENT INVENTION

1. Field of Invention

The present invention relates to rockers, and more particularly to an adjustable frame of rocker which rigidly supporting the rocking activity seat and providing the user of the rocking activity seat with multi-position inclined support. Thus, the rocking activity seat with the adjustable frame is facilitated to be folded into a compact unit for storage and carriage.

2. Description of Related Arts

Rocking activity seats have been known and sold throughout the United States since rocking activity seat becomes a necessity to every family especially having a young child or baby in which the rocking activity seat is considered as a convenience tool to rock the baby or young child to sleep.

A conventional rocking activity seat comprises a rocking frame and a seat frame supported by the rocking frame such that a toddler is laid on the seat frame in such a manner the rocking activity seat provides a smooth rocking action to soothe the toddler. However, the slope of the seat frame cannot be adjusted such that when the toddler tends to sit on the seat frame, the toddler fails to well support on the rocking activity seat.

An improved rocking activity seat further comprises a back frame in such a manner the back frame is adapted for adjusting with respect to the seat frame in order to provide an inclined back support for the toddler. However, the adjustable back frame may render the rolling activity seat losing its balance and turning over especially during the rocking action. As it is known that the toddler is soft and weak, if the toddler is not being supported properly, the toddler may get any unwanted injury from the rocking activity seat.

SUMMARY OF THE PRESENT INVENTION

A main object of the present invention is to provide an adjustable frame of rocker, which can well and balanced support a toddler laid thereon naturally and comfortably.

Another object of the present invention is to provide an adjustable frame of rocker, which inclination is adjustable, that is the slope of the back frame can be adjusted to fittingly support the toddler's back.

Another object of the present invention is to provide an adjustable frame of rocker, which enables the back frame to be inclinedly supported without altering or complicating the back frame and seat frame structure.

Another object of the present invention is to provide an adjustable frame of rocker which can be quickly and easily folded into a compact unit for carriage and storage and unfolded for use.

Accordingly, in order to accomplish the above objects, the present invention provides an adjustable frame for a rocking activity seat, comprising a rocking frame and a supporting frame comprising a back frame and a seat frame foldably coupled with the rocking frame wherein the rocking frame comprises:

a curved base frame for providing a rocking action of the rocking activity seat, a pair of supporting arms each pivotally connected to a front end portion of the base frame wherein each supporting arm is upwardly and inclindedly extended from the base frame, and a pair of coupling means for pivotally coupling two upper ends of the supporting arms with the supporting frame, so as to securely support the back frame in an inclined position.

DETAILED DESCRIPTION OF THE PREFERRED EMBODIMENT

Figure 1:
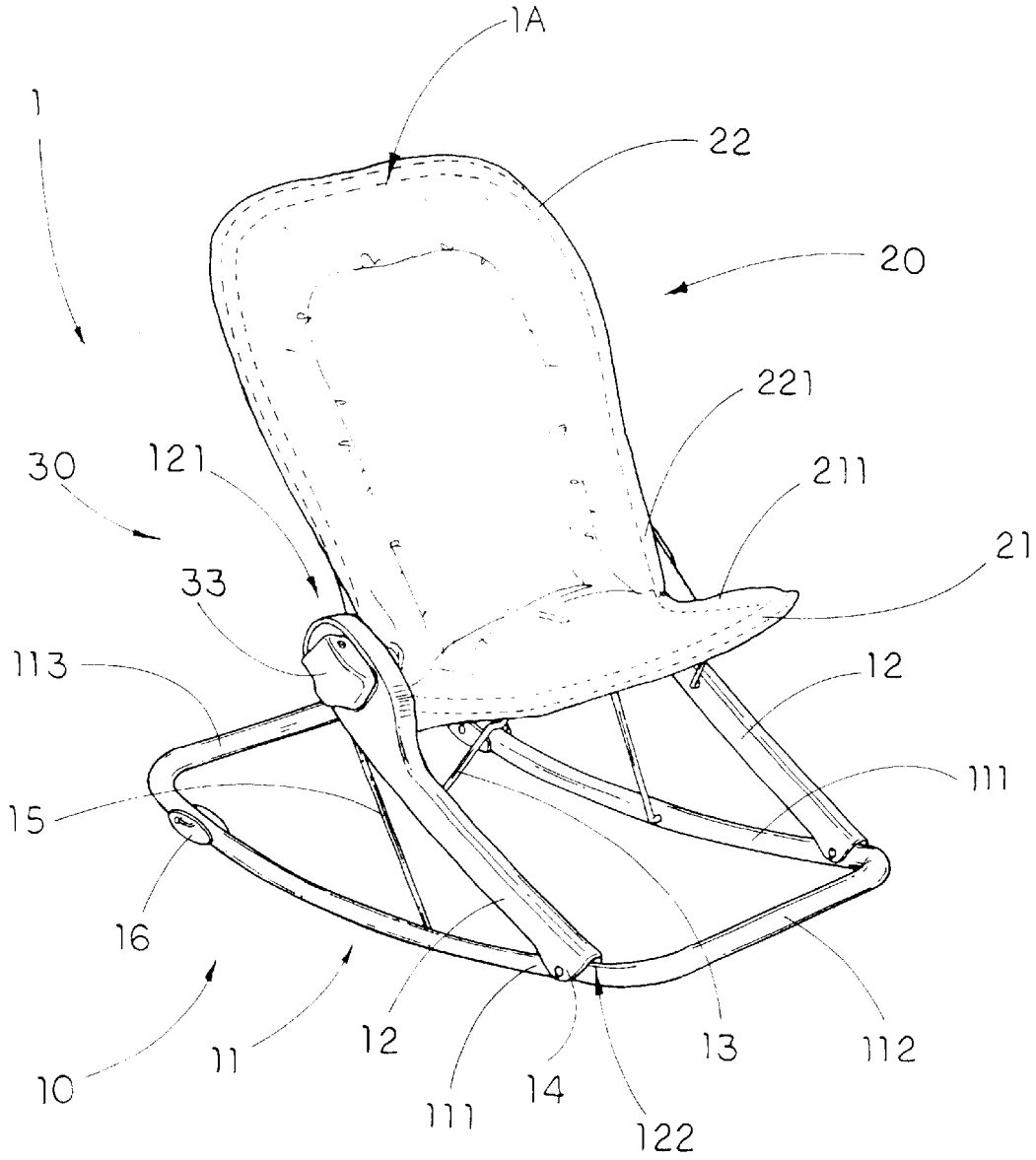
FIG. 1 is a perspective view of an adjustable frame of rocker according to a preferred embodiment of the present invention.

Referring to FIGS. 1 to 8 of the drawing, an adjustable frame 1 for a fabric seat 1A to mount thereon to form a rocking activity seat 2. The adjustable frame 1 comprises a rocking frame 10 and a supporting frame 20 foldably coupled with the rocking frame 10.

The supporting frame 20 comprises a seat frame 21 and a back frame 22 pivotally connected thereto wherein two end portions 211 of the U-shaped seat frame 21 and two ends portions 221 of the U-shaped back frame 22 are pivotally connected together respectively and arranged to form a rectangular shaped supporting frame 20 in such a manner the fabric seat 1A is rigidly supported on the supporting frame 20.

The rocking frame 10 comprises a curved base frame 11 for providing a rocking action of the rocking activity seat 1, a pair of supporting arms 12 each pivotally connected to a front end portion of the base frame 11 wherein each supporting arm 12 is upwardly and inclindedly extended from the base frame 11, a seat supportive means 13 pivotally connected between the seat frame 21 and the supporting arm 12 for rigidly supporting the seat frame 21, and a pair of coupling means 30 for pivotally coupling two upper ends 121 of the supporting arms 12 with the supporting frame 20.

The base frame 11 comprises a pair of parallel side frame legs 111 each having a curved shaped in such a manner the side frame legs 111 are arranged to drive the rocking activity seat 1 to swing backwards and forwards. The base frame 11 further comprises a front frame leg 112 and a rear frame leg 113 integrally extended between two front ends and two rear ends of the side frame legs 111 respectively to form a rectangular shaped base frame 11, so as to rigid the structure of the base frame 11 for securely supporting the supporting frame 20.

Figure 2:
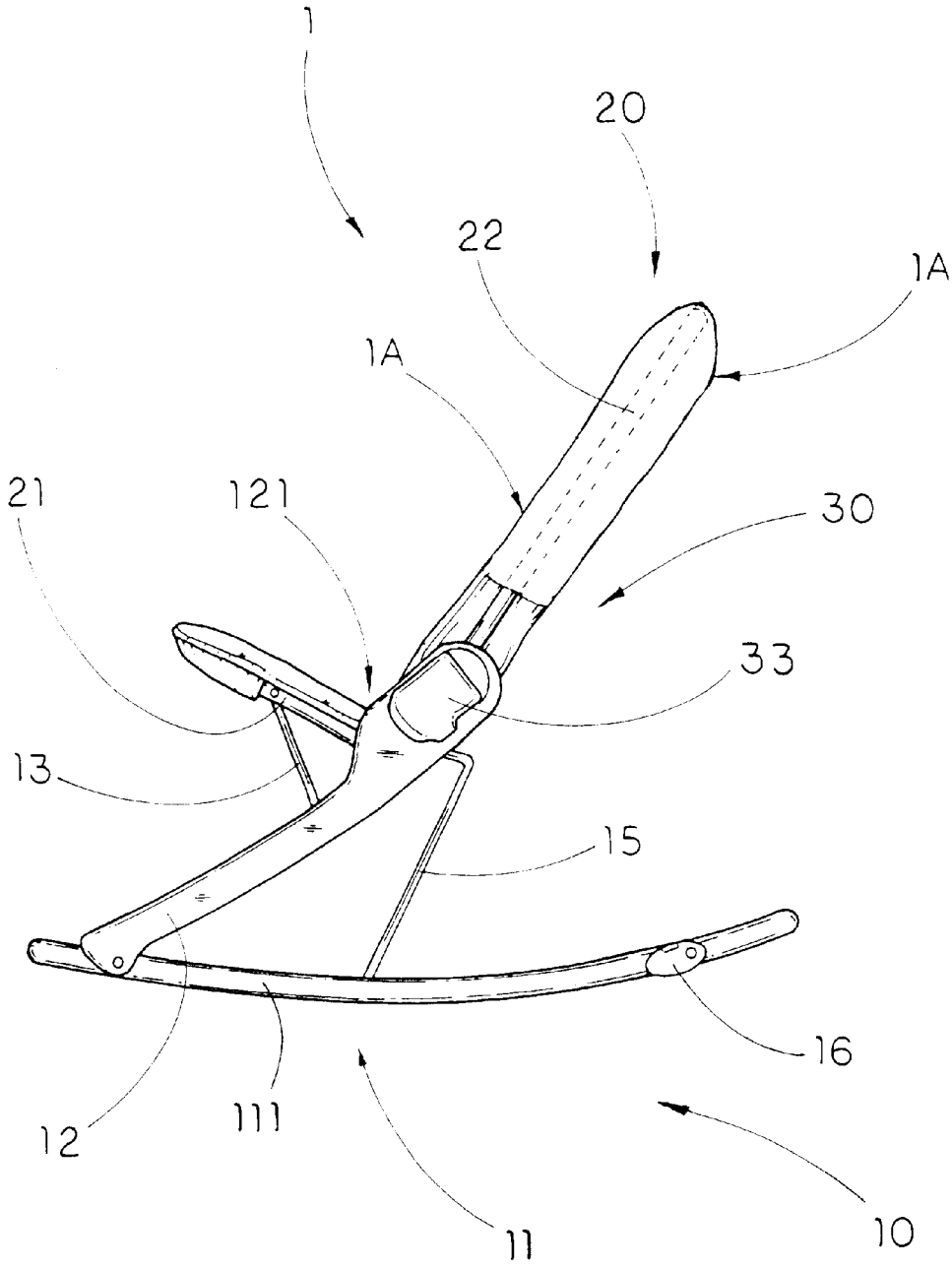
FIG. 2 is a side view of the adjustable frame of rocker according to the above preferred embodiment of the present invention.
Figure 3:
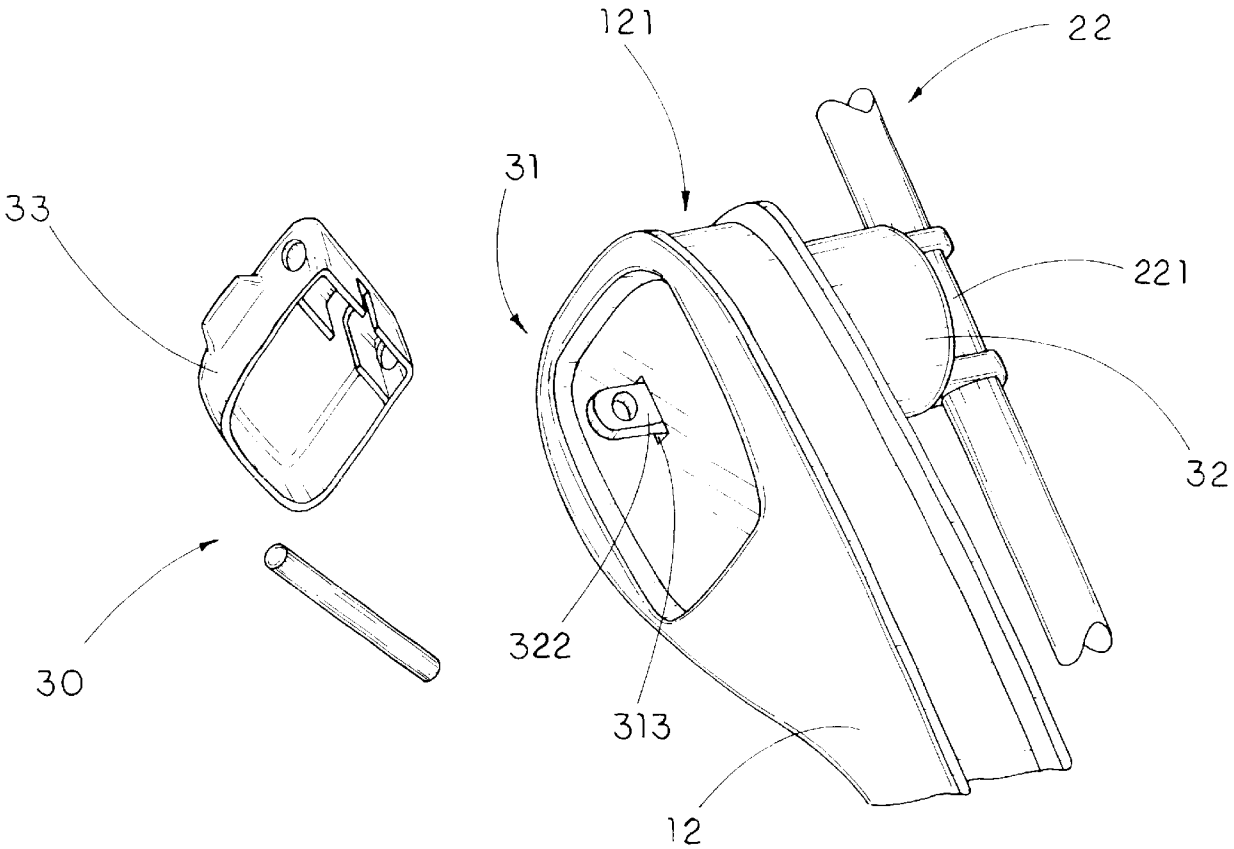
FIG. 3 is a partial exploded perspective of the coupling means of the adjustable frame of rocker according to the above preferred embodiment of the present invention.

Each supporting arm 12 is pivotally connected to a front end portion of each side frame leg 111 of the base frame 11 wherein each supporting arm 12 is upwardly and inclinedly extended therefrom for securely coupling with the supporting frame 20. In order to rigidly support the supporting frame 20 where the toddler is supported thereon, each supporting arm 12 has a U-shaped cross sectional structure defining a mounting channel 122 therein wherein the front end portion of the side frame leg 111 is disposed in the mounting channel 122 in such a manner the supporting arm 12 is pivotally connected at two sides of the side frame leg 111 of the base frame 11 by means of a pin joint 14. Moreover, when the rocking activity seat 1 is folded up, as shown in FIG. 2, the side frame legs 111 of the base frame 11 are respectively disposed in the mounting channels 122 of the supporting arms 12, so as to fold up into a compact unit.

The upper end 121 of each supporting arms 12 is pivotally connected with the back frame 22 by means of the coupling means 30 in such a manner the back frame 22 is adapted to be rotate around the upper end 121 of the supporting arm 12, so as to adjust the inclination of the back frame 22.

The seat supportive means 13, according to the preferably embodiment, which is a pair of seat support arm, is pivotally connected between the seat frame 21 and the supporting arm 12 for rigidly supporting the seat frame 21. In such arrangment, the back frame 22, the seat frame 21, and the supporting arm 12 are pivotally connected each other to form a triangular shaped structure, so as to securely supporting the toddler laid on the supporting frame 20. Moreover, when the back frame 22 is pivotally rotate about the supporting arm 12, the seat frame 21 is arranged to be driven to rotate through the seat supportive means 13. In other words, an angle between the back frame 22 and the seat frame 21 is automatically adjusted according to the inclination of the back frame 22. It is important that if the seat frame 21 is not rotatably adjusted with the inclined back frame 22, the center of gravity of the rocking activity seat 1 will be changed by varying the inclination of the back frame 22, which will make the rocking activity seat 1 unstable. So, the auto-adjustment of the seat frame 21 will stabilize the rocking activity seat 1, so as to prevent the rocking activity seat 1 from being flipped over during the rocking action.

The rocking frame 10 further comprises a stopper means 15 for limiting the inclination angle of the back frame 22 pivotally connected between the end portion 221 of the back frame 22 and a middle position of the side frame leg 111 of the base frame 11. The stopper means 15, which is a pair of guider arms, having L-shaped structure is arranged to be driven to rotate by the rotation of the back frame 22 wherein the bent portion of the stopper means 15 is adapted to block the rotation of the back frame 22 by the coupling means 30, so as to limit the inclination angle of the back frame 22. In other words, the inclination angle of the back frame 22 is limited by the stopper means 15 in order to prevent the back frame 22 from overhanging the base frame 11 that the rocking activity seat 1 may easily flip over during the rocking action thereof which may cause serious injury to the toddler when he or she laid on the rocking activity seat 1.

Figure 4:
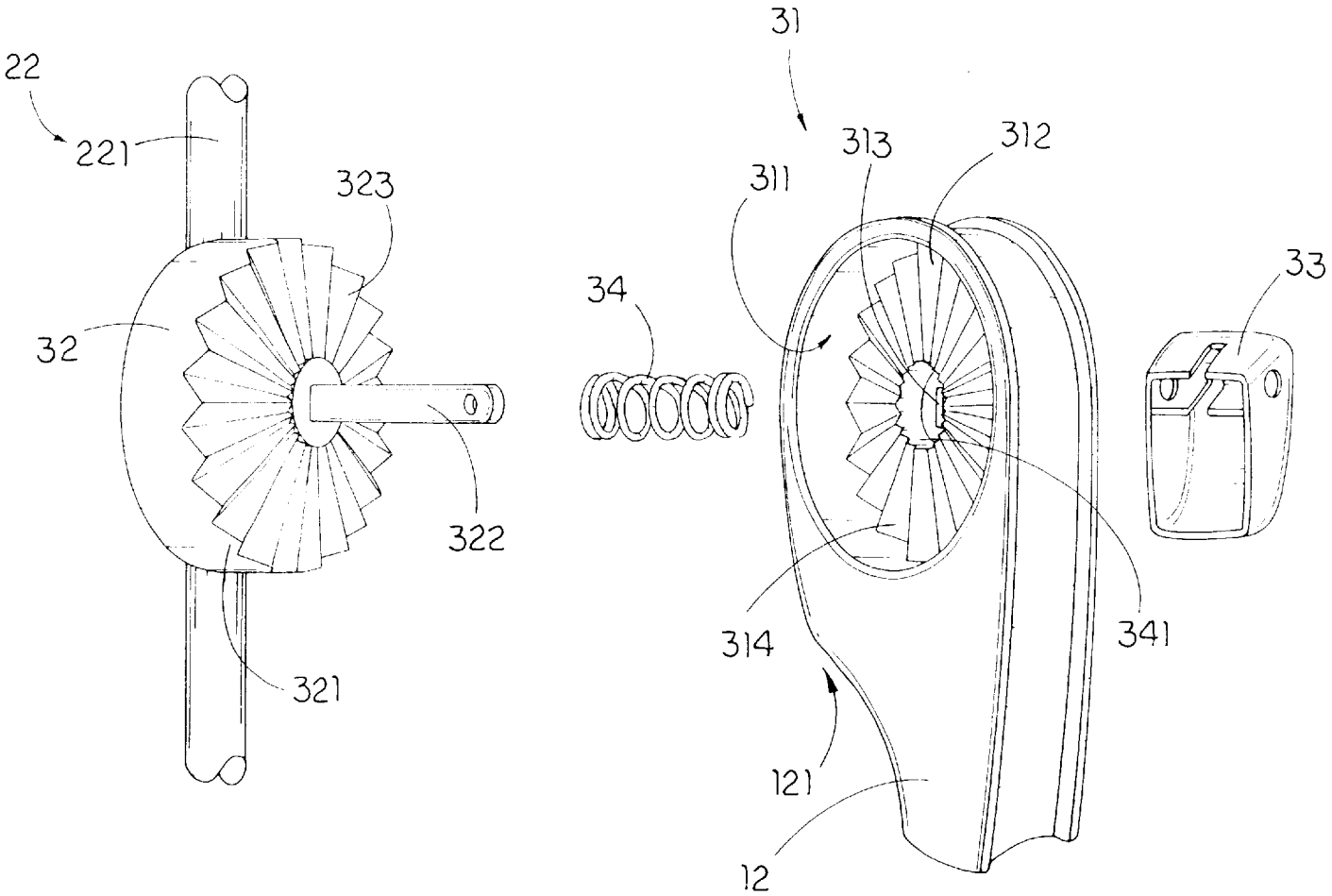
FIG. 4 is an exploded perspective view of the coupling means of the adjustable frame of rocker according to the above preferred embodiment of the present invention.
Figure 5:
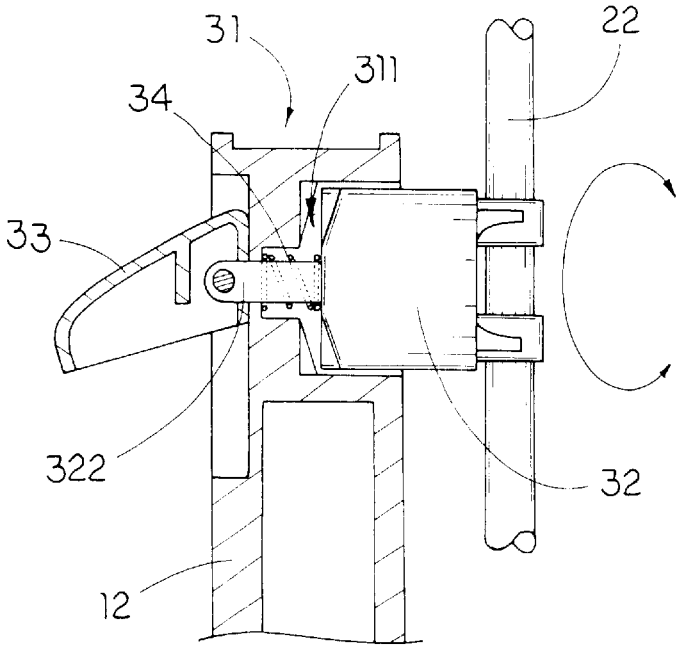
FIG. 5 is a sectional side view of the coupling means, during unlocked condition, of the adjustable frame of rocker according to the above preferred embodiment of the present invention.
Figure 6:
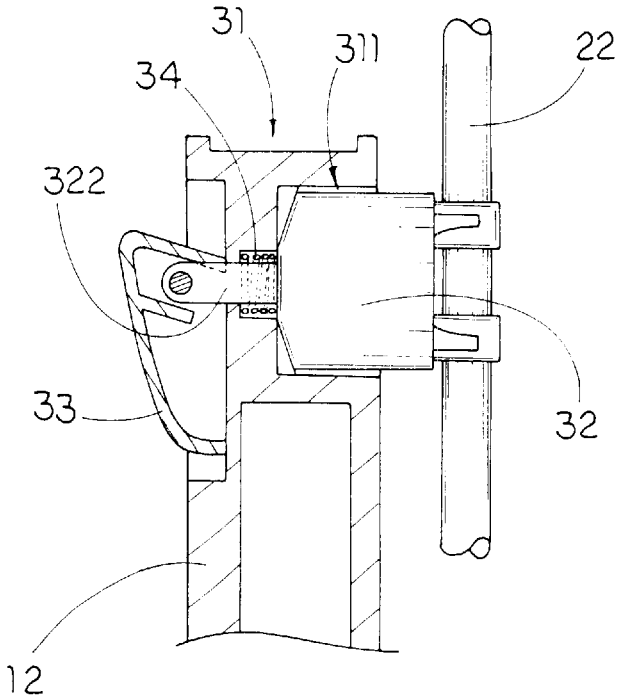
FIG. 6 is a sectional side view of the coupling means, during locked condition, of the adjustable frame of rocker according to the above preferred embodiment of the present invention.
Figure 7:
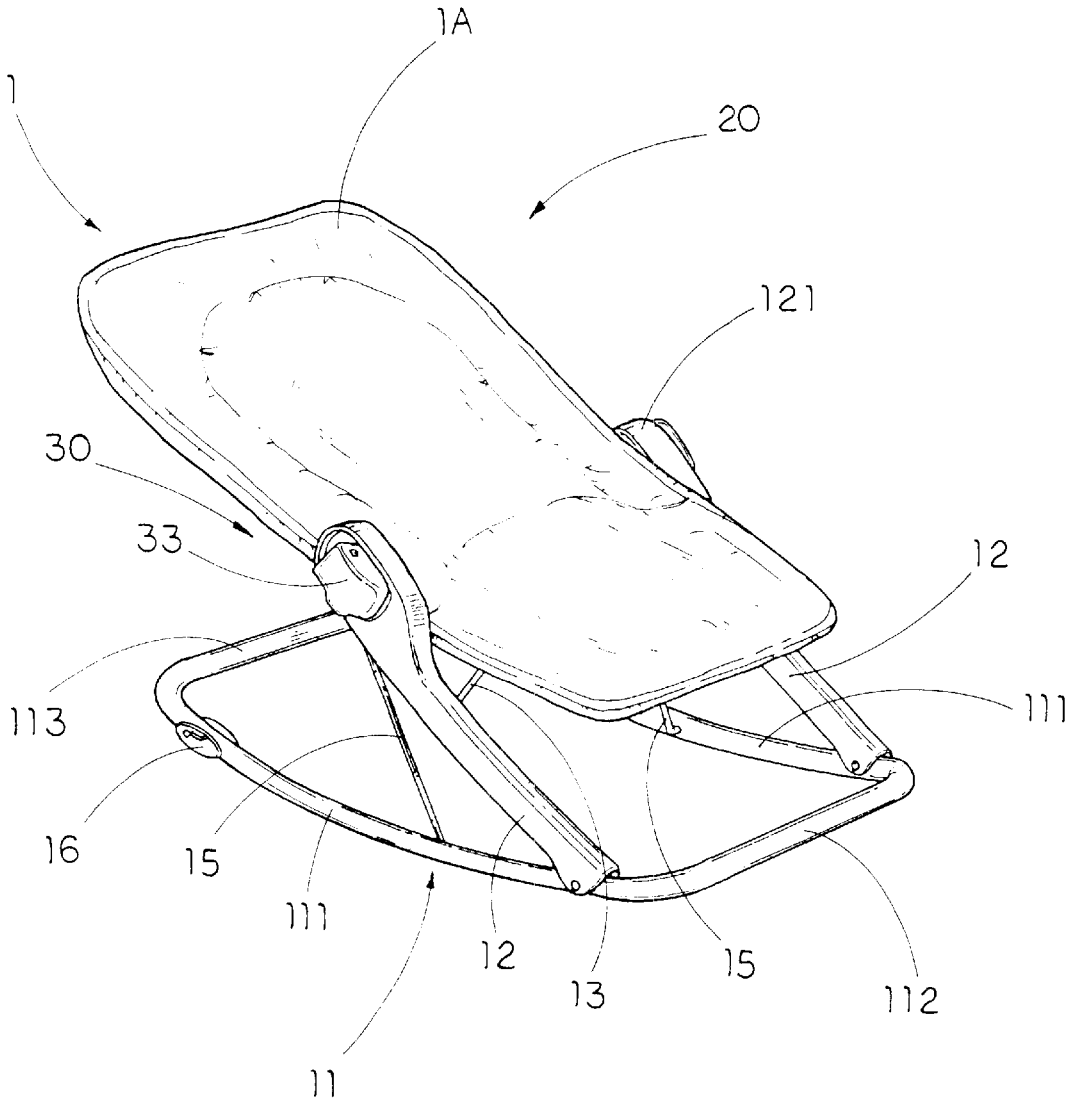
FIG. 7 is another perspective view of the adjustable frame of rocker according to the above preferred embodiment of the present invention.

Referring to FIG. 4 of the drawing, the coupling means 30 comprises a pair of outer housings 31, a pair of inner shafts 32, and a pair of operation buttons 33 for pivotally coupling two upper ends 121 of the two supporting arms 12 with the two end portions 221 of the back frame 22 of the supporting frame 20 respectively, so as to securely support the back frame 22 in an inclined position. The inclination of the back frame 22 is capable of adjusting when the coupling means 30 are in an unlocked position. In other words, during the unlocked position of the coupling means 30, the back frame 22 is adapted to be pivotally rotated back and forth in order to adjust the inclination of the back frame 22 with respect to the seat frame 21. In a locking position of the coupling means 30, the inclined back frame 22 is locked up in such a rotatably movable manner, so as to securely support the inclined back frame 22 in position.

Each cylindrical outer housing 31 is defined a coupling chamber 311 therein wherein each outer housing 31 is extended from each upper end 121 of the supporting arm 12 in such a manner the openings of the coupling chambers 311 are facing each other. Each outer housing 31 comprises an inner pusher wall 312 provided on a bottom surface of the coupling chamber 311 and a through slot 313 coaxially mounted on the outer housing 31 at its center. Accordingly, the each upper end 121 of the supporting arm 12 has an enlarged portion such that the outer housing 31 is integrally extended therefrom in such a manner the upper end 121 of the supporting arm 12 is enlarged to form the outer housing 31 of the coupling means 30.

Each rod-like inner shaft 32 is outwardly mounted on the end portion 221 of the back frame 22 of the supporting frame 20 aligning with the respective outer housing 31 such that the inner shaft 32 is fitly disposed in the coupling chamber 311 in such a rotatably movable manner, so as to fitly engage the inner shaft 32 with the outer housing 31 in the locking position of the coupling means 30. Each inner shaft 32 comprises an outer end wall 321 provided on an outer surface thereof and a driving axle 322 coaxially extended from a center of the end wall 321 in such a manner the driving axle 322 is arranged to penetrate through the through slot 313 of the outer housing 31, so as to coaxially align the inner shaft 32 with the outer housing 31.

Each operation button 33 is rotatably mounted on each free end of the driving axle 322 at an outer surface of the outer housing 31 wherein the operation buttons 33 are arranged to drive the coupling means 30 from a locking position to an unlocked position. In the unlocked position of the coupling means 30, the inner shaft 32 is freely rotated in the coupling chamber 311 of the outer housing 31 in such a manner the back frame 22 is freely rotated to adjust the inclination of the back frame 22. In the locking position, the inner shaft 32 is engaged with the outer housing 31 in such a air tight manner wherein a mutual friction between the pusher wall 312 of the outer housing 31 and the end wall 321 of the inner shaft 32 is provided therebetween so as to lock up the rotation of the back frame 22.

Each coupling means 30 further comprises a resilient element 34 disposed in the coupling chamber 311 and provided between the outer housing 31 and the inner shaft 32. The resilient element 34, which is a compression spring, has two ends biasing against the pusher wall 312 of the outer housing 31 and the end wall 321 of the inner shaft 32. Accordingly, the resilient element 34 will normally urge and retain the inner shaft 32 in the unlocked position of the coupling means 30 in such a manner the end wall 321 of the inner shaft 32 is moved away from the pusher wall 312 of the outer housing 31, so as to ensure the disengagement of the outer housing 31 and the inner shaft 32.

Moreover, in order to prevent the engagement between the outer housing 31 and the inner shaft 32 in such an air tight manner, a resilient element cavity 341 is coaxially provided on pusher wall 312 of the outer housing 31 in such a manner when the inner shaft 32 is engaged with the outer housing 31, which will compress the resilient element 34, the compressed resilient element 34 is entirely disposed in the resilient element cavity 341, so as to maximize the mutual friction between the pusher wall 312 of the outer housing 31 and the end wall 321 of the inner shaft 32. Furthermore, the resilient element cavity 341 is adapted to securely hold the resilient element 34 at its end in the coupling chamber 311 in position for ensuring the biasing pressure of the resilient element 34 is applied between the outer housing 31 and the inner shaft 32.

In addition, in order to increase the mutual friction between the pusher wall 312 of the outer housing 31 and end wall 321 of the inner shaft 32, a plurality of engaging teeth 323 are radially mounted on the end wall 321 of the inner shaft 32 for fitly engaging with a plurality of corresponding gear teeth 314 radially mounted on the pusher wall 312 of the outer housing 31 so as to enhance the outer housing 31 to lock up the inner shaft 32 in such rotatably movable manner. Thus, each engaging tooth 323 and each gear tooth 314 has a triangular cross sectional structure in such a manner the slope of each engaging tooth 323 and each gear tooth 314 will adjustably slide along each other for ensuring the prefect engagement between the inner shaft 32 and the outer housing 31.

Figure 8:
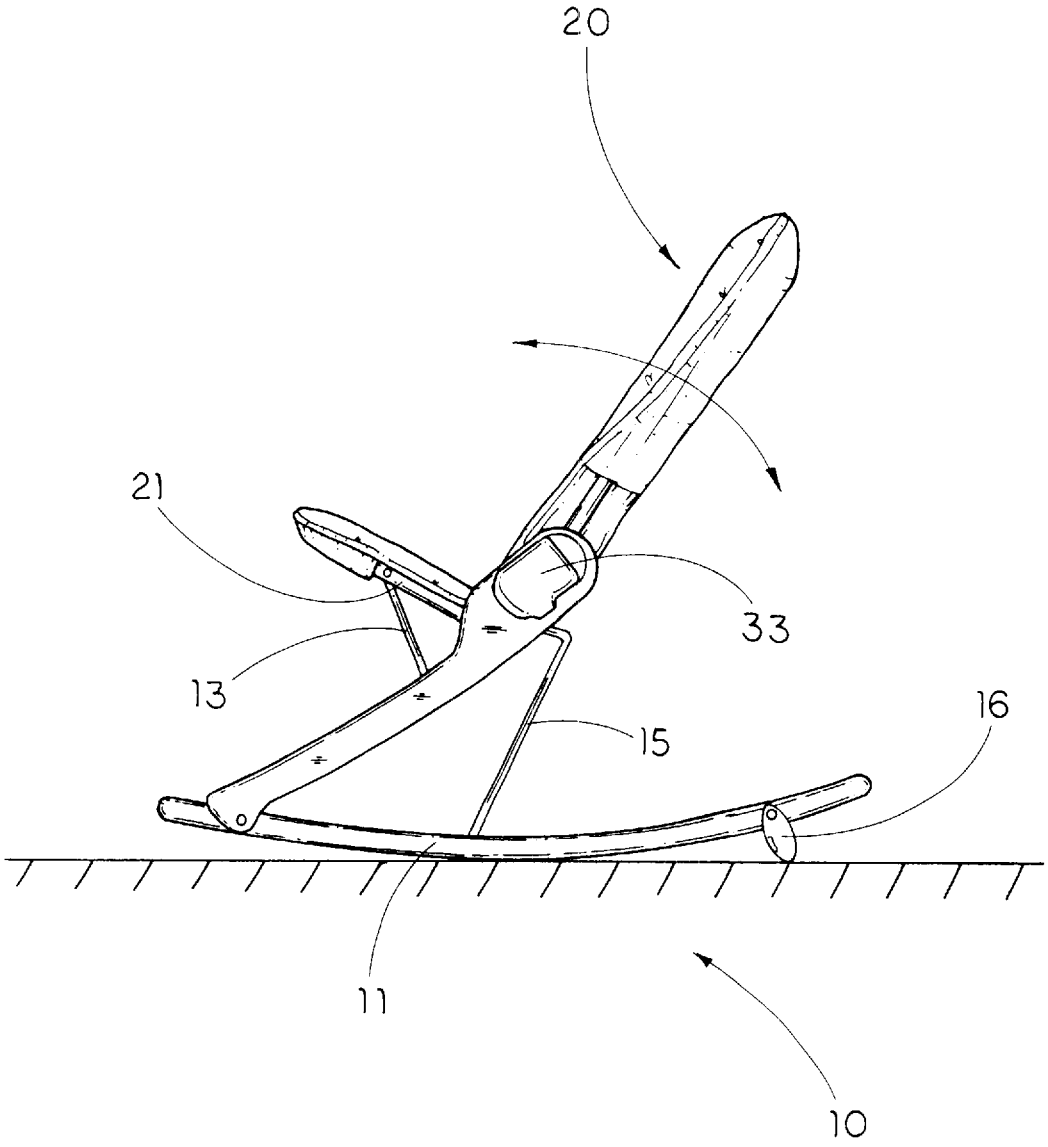
FIG. 8 is another side view of the adjustable frame of rocker according to the above preferred embodiment of the present invention, illustrating the stand piece sitting on ground to prevent rocking movement.

As shown in FIG. 8, a pair of stand pieces 16, which are pivotally affixed at the rear portions of the two parallel side frame legs 111 respectively, are able to be turned down to sit on ground so as to prevent any rocking movement, so that the user may sit on the rocker like a chair.

Figure 9:
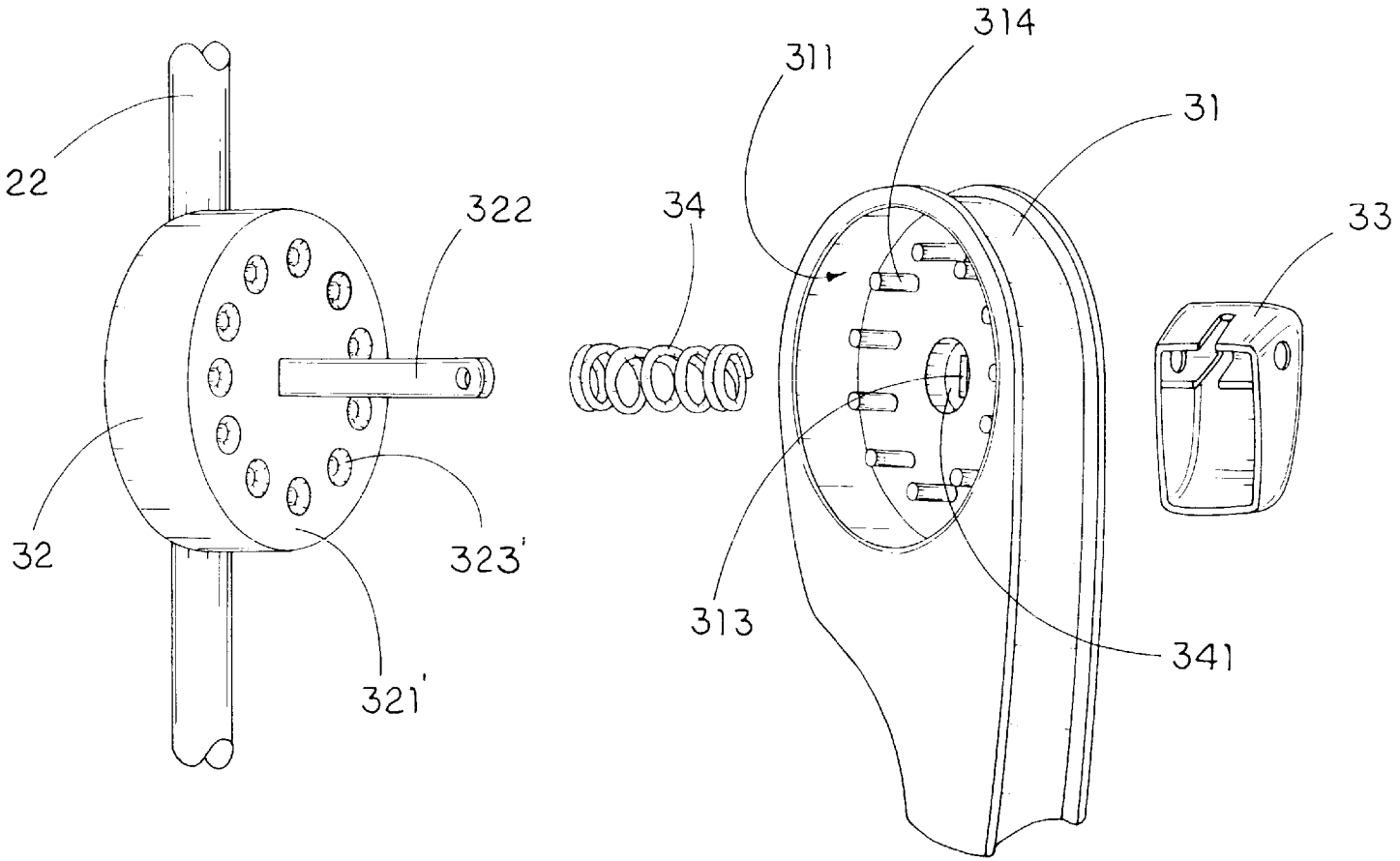
FIG. 9 illustrates an alternative mode of the coupling means of the adjustable frame of rocker according to the above preferred embodiment of the present invention.
Figure 10:
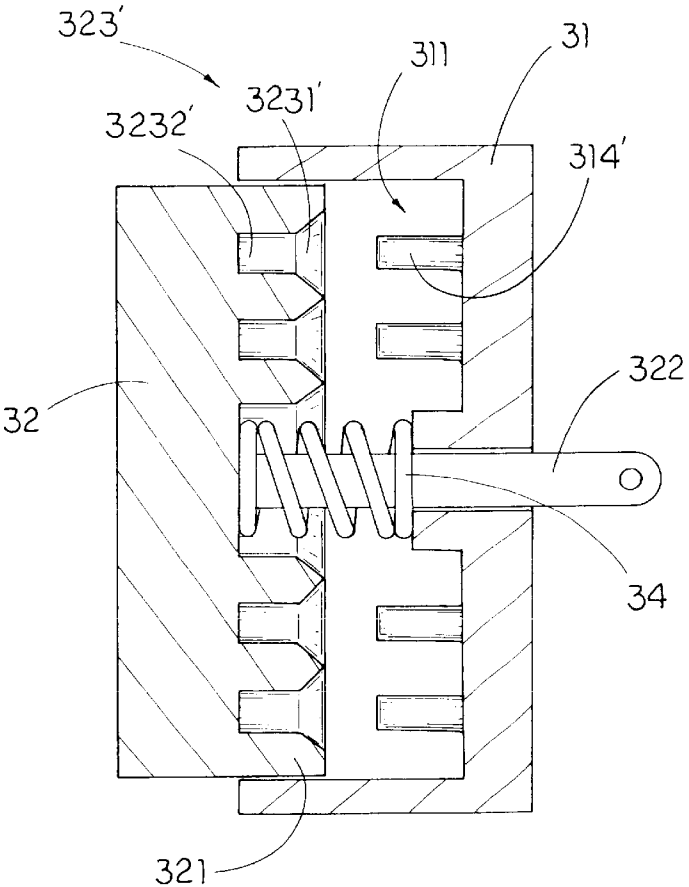
FIG. 10 is a sectional side view of the alternative mode of the coupling means of the adjustable frame of rocker according to the above preferred embodiment of the present invention.

Referring to FIGS. 9 and 10, an alternative mode of the coupling means 30' is illustrated in order to increase the mutual friction between the pusher wall 312 of the outer housing 31 and end wall 321 of the inner shaft 32, wherein a plurality of round-shaped locking sockets 323' are coaxially and inwardly formed on the end wall 321 of the inner shaft 32. Each locking socket 323' has a tapered outer portion 3231' and a cylindrical inner portion 3232' such that the outer portion 3231' of the locking socket 323' has a diameter gradually decrease towards to the inner portion 3232' thereof, as shown in FIG. 10.

The coupling means 30' further comprises a plurality of corresponding rod-like locking latches 314' coaxially and outwardly protruded from the pusher wall 312 of the outer housing 31, wherein the locking latches 314' are adapted for fitly inserting into the inner portion 3232' of the locking sockets 323' respectively for locking up a rotatable motion of the inner shaft 32, so as to lock up the back frame 22 at an inclination angle. It is worth to mention that the tapered outer portion 3231' of the locking socket 323' will help the correct alignment of the locking latches 314' to insert into the locking socket 323' because during engagement of the coupling means 30', each locking latch 314' can adjustably slide along a slope surface of the outer portion 3231' of the locking socket 323' in such a manner the locking latches 314' can perfectly insert into the locking sockets 323' in order to prevent misalignment of the engagement.

What is claimed is:

1. An adjustable frame for a rocking activity seat, comprising a rocking frame and a supporting frame comprising a seat frame and a back frame foldably coupled with said rocking frame wherein said rocking frame comprises:

a base frame comprising a pair of parallel side frame legs each having a curved shape for providing a rocking action of said rocking activity seat, a pair of supporting arms each pivotally connected to a front end portion of said side frame legs of said base frame respectively wherein each supporting arm extends upwardly and at an inclined position from said base frame, and a pair of coupling means for pivotally coupling two upper ends of said supporting arms with said supporting frame, so as to selectively adjust an inclination angle of said back frame with respect to said seat frame, wherein each of said coupling means comprises an outer housing, having a center through slot and an inner pusher wall, attached to said upper end of said supporting arm, an inner shaft, which is attached to an end portion of said back frame, having an outer end wall and a driving axle coaxially extended from a center of said inner shaft and penetrated through said through slot, and an operation button rotatably mounted on a free end of said driving axle at an outer surface of said outer housing for operating said inner shaft to move between a locking position and an unlocking position, wherein in said locking position, said end wall of said inner shaft is biased against said pusher wall of said outer housing for securely engaging said inner shaft with said outer housing so as to lock up said back frame in a rotating manner, and in said unlocking position, said end wall of said inner shaft is moved away from said pusher wall of said outer housing such that said back frame is in a free rotating manner, wherein a plurality of round-shaped locking sockets coaxially and inwardly formed on said end wall of said inner shaft and a plurality of corresponding locking latches coaxially and outwardly protruded from said pusher wall of said outer housing wherein said locking latches are adapted for fittedly inserting into said locking sockets respectively for locking up a rotatable motion of said inner shaft so as to lock up said back frame at an inclination angle, wherein each of said locking socket has a tapered outer portion and a cylindrical inner portion such that said outer portion of said locking socket has a diameter gradually decrease towards to said inner portion thereof.

2. An adjustable frame for a rocking activity seat, comprising a rocking frame and a supporting frame comprising a seat frame and a back frame foldably coupled with said rocking frame wherein said rocking frame comprises:

a base frame comprising a pair of parallel side frame legs each having a curved shape for providing a rocking action of said rocking activity seat, a pair of supporting arms each pivotally connected to a front end portion of said side frame legs of said base frame respectively wherein each supporting arm extends upwardly and at an inclined position from said base frame, and a pair of coupling means for pivotally coupling two upper ends of said supporting arms with said supporting frame, so as to selectively adjust an inclination angle of said back frame with respect to said seat frame, wherein each of said coupling means comprises an outer housing, having a center through slot and an inner pusher wall, attached to said upper end of said supporting arm, an inner shaft, which is attached to an end portion of said back frame, having an outer end wall and a driving axle coaxially extended from a center of said inner shaft and penetrated through said through slot, and an operation button rotatably mounted on a free end of said driving axle at an outer surface of said outer housing for operating said inner shaft to move between a locking position and an unlocking position, wherein in said locking position, said end wall of said inner shaft is biased against said pusher wall of said outer housing for securely engaging said inner shaft with said outer housing so as to lock up said back frame in a rotating manner, and in said unlocking position, said end wall of said inner shaft is moved away from said pusher wall of said outer housing such that said back frame is in a free rotating manner, wherein said outer housing having a cylindrical shaped defines a coupling chamber wherein said pusher wall is provided on a bottom surface of said coupling chamber, and said inner shaft is fittedly disposed in said coupling chamber of said outer housing in a rotatably movable manner, wherein a plurality of round-shaped locking sockets coaxially and inwardly formed on said end wall of said inner shaft and a plurality of corresponding locking latches coaxially and outwardly protruded from said pusher wall of said outer housing wherein said locking latches are adapted for fittedly inserting into said locking sockets respectively for locking up a rotatable motion of said inner shaft so as to lock up said back frame at an inclination angle, wherein each of said locking socket has a tapered outer portion and a cylindrical inner portion such that said outer portion of said locking socket has a diameter gradually decrease towards to said inner portion thereof.

3. An adjustable frame for a rocking activity seat, comprising a rocking frame and a supporting frame comprising a seat frame and a back frame foldably coupled with said rocking frame wherein said rocking frame comprises:

a base frame comprising a pair of parallel side frame legs each having a curved shape for providing a rocking action of said rocking activity seat, a pair of supporting arms each pivotally connected to a front end portion of said side frame legs of said base frame respectively, wherein each supporting arm extends upwardly and at an inclined position from said base frame, wherein each of said supporting arms has a U-shaped cross sectional structure defining a mounting channel therein and arranged in such a manner that said side frame leg is received in said mounting channel of said supporting arms when said rocking activity seat is pivotally folded up, and a pair of coupling means for pivotally coupling two upper ends of said supporting arms with said supporting frame, so as to selectively adjust an inclination angle of said back frame with respect to said seat frame, wherein each of said coupling means comprises an outer housing, having a center through slot and an inner pusher wall, attached to said upper end of said supporting arm, an inner shaft, which is attached to an end portion of said back frame, having an outer end wall and a driving axle coaxially extended from a center of said inner shaft and penetrated through said through slot, and an operation button rotatably mounted on a free end of said driving axle at an outer surface of said outer housing for operating said inner shaft to move between a locking position and an unlocking position, wherein in said locking position, said end wall of said inner shaft is biased against said pusher wall of said outer housing for securely engaging said inner shaft with said outer housing so as to lock up said back frame in a rotating manner, and in said unlocking position, said end wall of said inner shaft is moved away from said pusher wall of said outer housing such that said back frame is in a free rotating manner, wherein said coupling means further comprises a resilient element disposed between said outer housing and said inner shaft wherein said resilient element has two ends biasing against said end wall of said inner shaft and said pusher wall to push said end wall of said inner shaft away from said pusher wall of said outer housing so as to urge and retain said coupling means in said unlocking position, wherein said outer housing further has a resilient element cavity coaxially provided on said pusher wall for securely holding one end of said resilient element so as to ensure a biasing pressure of said resilient element is applied between said outer h ousing and inner shaft, and wherein said resilient element is entirely disposed in said resilient element cavity when said inner shaft is engaged with said outer housing so as to maximize a mutual friction between said pusher wall of said outer housing and said end wall of inner shaft, wherein said outer housing having a cylindrical shaped defines a coupling chamber wherein said pusher wall is provided on a bottom surface of said coupling chamber, and said inner shaft is fittedly disposed in said coupling chamber of said outer housing in a rotatably movable manner.

4. An adjustable frame for a rocking activity seat, comprising a rocking frame and a supporting frame comprising a seat frame and a back frame foldably coupled with said rocking frame wherein said rocking frame comprises:

a base frame comprising a pair of parallel side frame legs each having a curved shape for providing a rocking action of said rocking activity seat, a pair of supporting arms each pivotally connected to a front end portion of said side frame legs of said base frame respectively, wherein each supporting arm extends upwardly and at an inclined position from said base frame, a pair of coupling means for pivotally coupling two upper ends of said supporting arms with said supporting frame, so as to selectively adjust an inclination angle of said back frame with respect to said seat frame, wherein each of said coupling means comprises an outer housing, having a center through slot and an inner pusher wall, attached to said upper end of said supporting arm, an inner shaft, which is attached to an end portion of said back frame, having an outer end wall and a driving axle coaxially extended from a center of said inner shaft and penetrated through said through slot, and an operation button rotatably mounted on a free end of said driving axle at an outer surface of said outer housing for operating said inner shaft to move between a locking position and an unlocking position, wherein in said locking position, said end wall of said inner shaft is biased against said pusher wall of said outer housing for securely engaging said inner shaft with said outer housing so as to lock up said back frame in a rotating manner, and in said unlocking position, said end wall of said inner shaft is moved away from said pusher wall of said outer housing such that said back frame is in a free rotating manner, wherein said coupling means further comprises a resilient element disposed between said outer housing and said inner shaft wherein said resilient element has two ends biasing against said end wall of said inner shaft and said pusher wall to push said end wall of said inner shaft away from said pusher wall of said outer housing so as to urge and retain said coupling means in said unlocking position, wherein said outer housing further has a resilient element cavity coaxially provided on said pusher wall for securely holding one end of said resilient element so as to ensure a biasing pressure of said resilient element is applied between said outer housing and inner shaft, and wherein said resilient element is entirely disposed in said resilient element cavity when said inner shaft is engaged with said outer housing so as to maximize a mutual friction between said pusher wall of said outer housing and said end wall of inner shaft, wherein said outer housing having a cylindrical shaped defines a coupling chamber wherein said pusher wall is provided on a bottom surface of said coupling chamber, and said inner shaft is fittedly disposed in said coupling chamber of said outer housing in a rotatably movable manner, and a stopper means for limiting an inclination angle of said back frame wherein said stopper means comprises a pair of L-shaped guider arms each pivotally connected between said end portion of said back frame and a middle portion of said side frame leg wherein bent portions of said two guider arm are adapted for biasing against said coupling means respectively so as to limit said inclination angle of said back frame.

5. An adjustable frame for a rocking activity seat, comprising a rocking frame and a supporting frame comprising a seat frame and a back frame foldably coupled with said rocking frame wherein said rocking frame comprises:

a base frame comprising a pair of parallel side frame legs each having a curved shape for providing a rocking action of said rocking activity seat, a pair of supporting arms each pivotally connected to a front end portion of said side frame legs of said base frame respectively wherein each supporting arm extends upwardly and at an inclined position from said base frame, wherein each of said supporting arms has a U-shaped cross sectional structure defining a mounting channel therein and arranged in such a manner that said side frame leg is received in said mounting channel of said supporting arms when said rocking activity seat is pivotally folded up, and a pair of coupling means for pivotally coupling two upper ends of said supporting arms with said supporting frame, so as to selectively adjust an inclination angle of said back frame with respect to said seat frame, wherein each of said coupling means comprises an outer housing, having a center through slot and an inner pusher wall, attached to said upper end of said supporting arm, an inner shaft, which is attached to an end portion of said back frame, having an outer end wall and a driving axle coaxially extended from a center of said inner shaft and penetrated through said through slot, and an operation button rotatably mounted on a free end of said driving axle at an outer surface of said outer housing for operating said inner shaft to move between a locking position and an unlocking position, wherein in said locking position, said end wall of said inner shaft is biased against said pusher wall of said outer housing for securely engaging said inner shaft with said outer housing so as to lock up said back frame in a rotating manner, and in said unlocking position, said end wall of said inner shaft is moved away from said pusher wall of said outer housing such that said back frame is in a free rotating manner.

6. The adjustable frame, as recited in claim 5, further comprising a seat supportive means for rigidly supporting said seat frame, wherein said seat supportive means comprises a pair of seat support arm having two ends pivotally connected said seat frame and said supporting arm respectively in such a manner that an inclination angle between said back frame and said seat frame is automatically adjusted for stabilization purpose when said back frame is pivotally rotated with respect to said supporting arms.

7. The adjustable frame, as recited in claim 6, further comprising a stopper means for limiting an inclination angle of said back frame wherein said stopper means comprises a pair of L-shaped guider arms each pivotally connected between said end portion of said back frame and a middle portion of said side frame leg wherein bent portions of said two guider arm are adapted for biasing against said coupling means respectively so as to limit said inclination angle of said back frame.

8. the adjustable frame, as recited in claim 7, further comprising a pair of stand pieces, which are pivotally affixed at two rear portion of said two side frame legs respectively, are adapted for pivotally rotating downwardly to sit on ground so as to stop said rocking action of said rocking activity seat.

9. An adjustable frame for a rocking activity seat, comprising a rocking frame and a supporting frame comprising a seat frame and a back frame foldably coupled with said rocking frame wherein said rocking frame comprises:

a base frame comprising a pair of parallel side frame legs each having a curved shape for providing a rocking action of said rocking activity seat, a pair of supporting arms each pivotally connected to a front end portion of said side frame legs of said base frame respectively wherein each supporting arm extends upwardly and at an inclined position from said base frame, a pair of coupling means for pivotally coupling two upper ends of said supporting arms with said supporting frame, so as to selectively adjust an inclination angle of said back frame with respect to said seat frame, and a stopper means for limiting an inclination angle of said back frame wherein said stopper means comprises a pair of L-shaped guider arms each pivotally connected between said end portion of said back frame and a middle portion of said side frame leg wherein bent portions of said two guider arm are adapted for biasing against said coupling means respectively so as to limit said inclination angle of said back frame.

* * * * *